US006414574B1

(12) United States Patent
Knöchel et al.

(10) Patent No.: US 6,414,574 B1
(45) Date of Patent: Jul. 2, 2002

(54) POTENTIAL-FREE CONNECTION FOR MICROWAVE TRANSMISSION LINE

(75) Inventors: Reinhard Knöchel, Elmshorn; Matthias Weiss, Hamburg, both of (DE)

(73) Assignee: Krohne Messtechnik GmbH & Co. KG (DE)

( * ) Notice: Subject to any disclaimer, the term of this patent is extended or adjusted under 35 U.S.C. 154(b) by 0 days.

(21) Appl. No.: 09/707,789

(22) Filed: Nov. 7, 2000

(30) Foreign Application Priority Data

Nov. 12, 1999 (DE) ..... 199 54 742
Dec. 4, 1999 (DE) ..... 199 58 560

(51) Int. Cl.[7] ..... H01P 3/08
(52) U.S. Cl. ..... 333/246; 333/260
(58) Field of Search ..... 333/246, 260, 333/33

(56) References Cited

FOREIGN PATENT DOCUMENTS

DE 2943502 C 5/1980

OTHER PUBLICATIONS

Matthew M. Radmanesh and Bradford W. Arbold. "Generalized Microstrip–Slotline Transitions: Theory and Simulation vs. Experiment", Microwave Journal, Jun. 1993.

*Primary Examiner*—Robert Pascal
*Assistant Examiner*—Joseph Chang
(74) *Attorney, Agent, or Firm*—Cesari and McKenna LLP

(57) ABSTRACT

A potential-free connection of a first line section of a microwave transmission line with a second line section of the microwave transmission line is described and illustrated. To obtain a broadband transfer range for the microwave signal with high breakdown voltage at the same time, it is provided for that the first line section of the microwave transmission line has a first slotted line, the second line section of the microwave transmission line has a second slotted line and the first slotted line and the second slotted line are arranged on two opposite sides of a dielectric substrate in such a way that the first slotted line and the second slotted line have a strong electromagnetic coupling but have no conductive connection to each other.

11 Claims, 3 Drawing Sheets

POTENTIAL-FREE CONNECTION FOR MICROWAVE TRANSMISSION LINE

BACKGROUND OF THE INVENTION

The invention relates to a potential-free connection of a first line section of a microwave transmission line with a second line section of the microwave transmission line. Potential-free signifies in this instance that there is no electrically conductive connection.

With applications in microwave technology, situations often occur in which an electrical separation between a measuring value recorder, on the one hand, and a measuring value processing system, on the other hand, is required for a measurement. Such an electrical separation, i.e., a potential-free transition between two separate line sections one of which is connected with the measured value recorder and the other of which is connected with the measured value processing system, can be achieved in principle by means of a transformer, an optoelectronic coupler, or with the help of two capacitors, with one of the capacitors provided in the signal line and the other capacitor provided in the reference line. Such constructions do not represent practicable solutions in the microwave frequency range, however. Alternative solutions with a number of capacitors are indeed conceivable, but such arrangements have only a very small transferable bandwidth, and the breakdown voltage for such a system is only a few hundred volts.

The technical problem of the invention is accordingly to provide a potential-free connection of a first line section of a microwave transmission line with a second line section of the microwave transmission line, in connection with which the potential-free connection should ensure a broadband transfer range for the microwave signal with high breakdown voltage at the same time.

SUMMARY OF THE INVENTION

The potential-free connection according to the invention, with which the technical problem derived and described above is solved, is characterized in that the first line section of of the microwave transmission line has a first slotted line, the second line section of the microwave transmission line has a second slotted line and the first slotted line and the second slotted line are each arranged on two opposite sides of a dielectric substrate in such a way that the first slotted line and the second slotted line have a strong electromagnetic coupling but have no electrically conductive connection to each other, i.e., no ohmic contact exists between the first slotted line and the second slotted line.

A preferred further development of the potential-free connection according to the invention consists in that the first slotted line and the second slotted line are straight. Furthermore, the first slotted line preferably extends parallel to the second slotted line, and it is particularly preferable for the first slotted line to extend in true alignment with the second slotted line.

According to a preferred further development of the invention, a particularly good electromagnetic coupling between the first slotted line and the second slotted line is achieved without a conductive connection between them if at one of its end areas, the first slotted line overlaps the second slotted line at one of the latter's end areas. In this connection, it is particularly preferred for the first slotted line and the second slotted line to each be widened in the area where the two overlap.

Impedance is optimally adapted, according to a preferred further development of the invention, in that the first slotted line and the second slotted line are each widened beyond the area where they overlap. In this connection, a particularly preferred further development of the potential-free connection according to the invention has proven to be a sizing in which the first slotted line and the second slotted line are each widened over a length of 5.5 mm and overlap over a length of 4 mm.

The potential-free connection according to the invention can be produced with various thicknesses of the dielectric substrate. A 0.1 to 0.4 mm thickness of the dielectric substrate has proven particularly suitable for the potential-free connection according to the invention; a 0.25 mm thickness of the dielectric substrate is particularly preferred.

With appropriate geometric adaptation of the overlapping slotted lines, dielectric substrates with the widest variety of dielectric constants can be used for the potential-free connection according to the invention. According to a preferred further development of the potential-free connection, a particularly good electromagnetic coupling between the two overlapping slotted lines is obtained when the dielectric constant of the dielectric. substrate is between 1.5 and 5, with a 2.2 dielectric constant of the dielectric substrate being particularly preferred.

For adaptation to an existing circuit arrangement, a construction in which the first line section and/or the second line section each have a transition from the slotted line to a microstrip line has proven to be a particularly preferred further development. In this way, the microwave signal can be fed in or forwarded particularly easily with a coaxial, line through a respective transition from the coaxial line to the microstrip line and vice versa. In this respect, a particularly preferred further development of the potential-free connection according to the invention consists in that at the respective transition from the slotted line to the microstrip line, the slotted line overlaps the microstrip line, the slotted line runs perpendicular to the microstrip line, the microstrip line ends straight shortly after its overlapping with the slotted line, and shortly after its overlapping with the microstrip line, the slotted line ends with a circular recess whose radius corresponds to roughly twice the slot width of the slotted line. In this connection, the slotted line is in the mass surface of the microstrip line, so it has direct contact with the latter line. In this way, a particularly compact transition from the slotted line to the microstrip line is possible.

BRIEF DESCRIPTION OF THE DRAWINGS

In detail, there are now numerous possibilities for designing and further developing the potential-free connection according to the invention. For this purpose, the dependent patent claims on the one hand and, on the other hand, the following detailed description of potential-free connections according to preferred embodiments of the invention are pointed out, referring to the drawings. The following are shown in the drawings:

DESCRIPTION OF THE PREFERRED EMBODIMENTS

Figure 1:
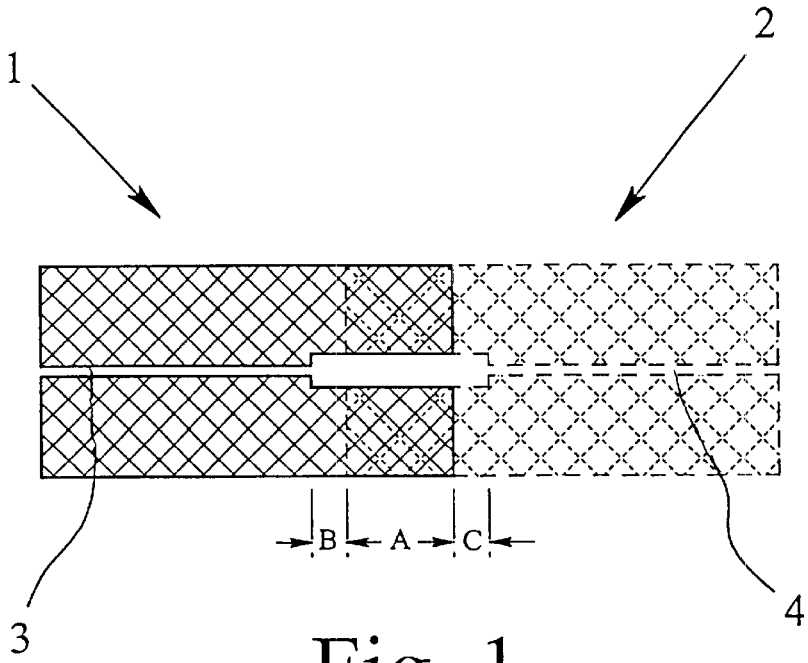
FIG. 1 in schematic form, the two slotted lines—overlapping at their end areas—of a potential-free connection according to a preferred embodiment of the invention, FIG. 2 in detailed schematic illustration, the transition from a slotted line to a microstrip line for the potential-free connection according to a preferred embodiment of the invention, FIG. 3 an equivalent circuit diagram for a transition from the slotted line to the microstrip line for the potential-free connection according to a preferred embodiment of the invention, FIG. 4 in schematic form, the overall arrangement of the potential-free connection according to a preferred embodiment of the invention, and FIG. 5 in schematic form, the overall arrangement of the potential-free connection according to optimally improved, preferred embodiment of the invention.

As can be seen from FIG. 1, a first line section 1 and a second line section 2 of a microwave transmission line are provided for a potential-free connection according to a preferred embodiment of the invention; in this connection, the first line section 1 of the microwave transmission line has a first slotted line 3 and the second line section 2 of the microwave transmission line has a second slotted line 4. The two slotted lines 3, 4 are arranged on two opposite sides of a dielectric substrate 5 shown in FIG. 4.

As FIG. 1 further shows, the first slotted line 3 and the second slotted line 4 are widened in their respective end areas. With these widened end areas one precisely above the other, the first slotted line 3 overlaps the second slotted line 4 in an area marked A in FIG. 1 and which is 4 mm long according to the first preferred embodiment of the invention. The areas marked B and C represent areas in which the end areas of the first slotted line 3 and the second slotted line 4, respectively, are indeed widened, but the first slotted line 3 does not overlap the second slotted line 4. These areas B and C are each 1.5 mm long according to the preferred embodiment of the invention and serve to adapt the impedance. There is no ohmic contact between the first slotted line 3 and the second slotted line 4 and thus no conductive connection.

The substrate 5, on whose opposite sides the slotted line 3 and the slotted line 4 are attached, is 0.25 mm thick with a dielectric constant of 2.2 according to the preferred embodiment of the invention. This arrangement can be used to achieve a potential-free connection of the first line section 1 of the microwave transmission line with the second line section 2 of the microwave transmission line that has a breakdown voltage of more than 1 kV when there is a strong coupling between the first slotted line 3 and the second slotted line 4.

Figure 2:
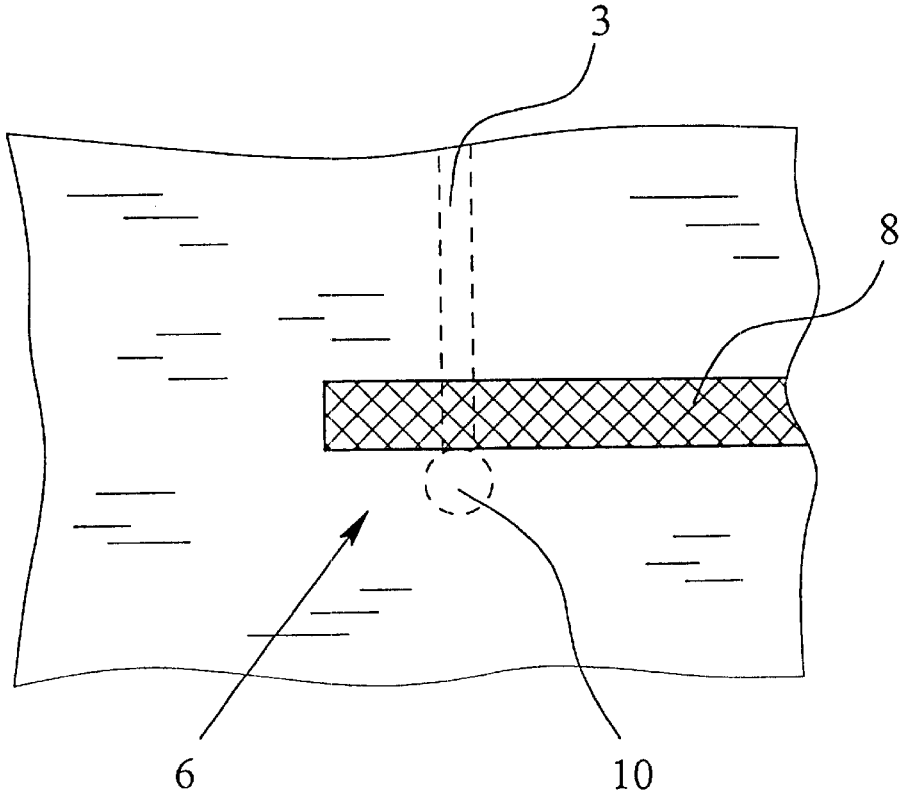
Figure 4:
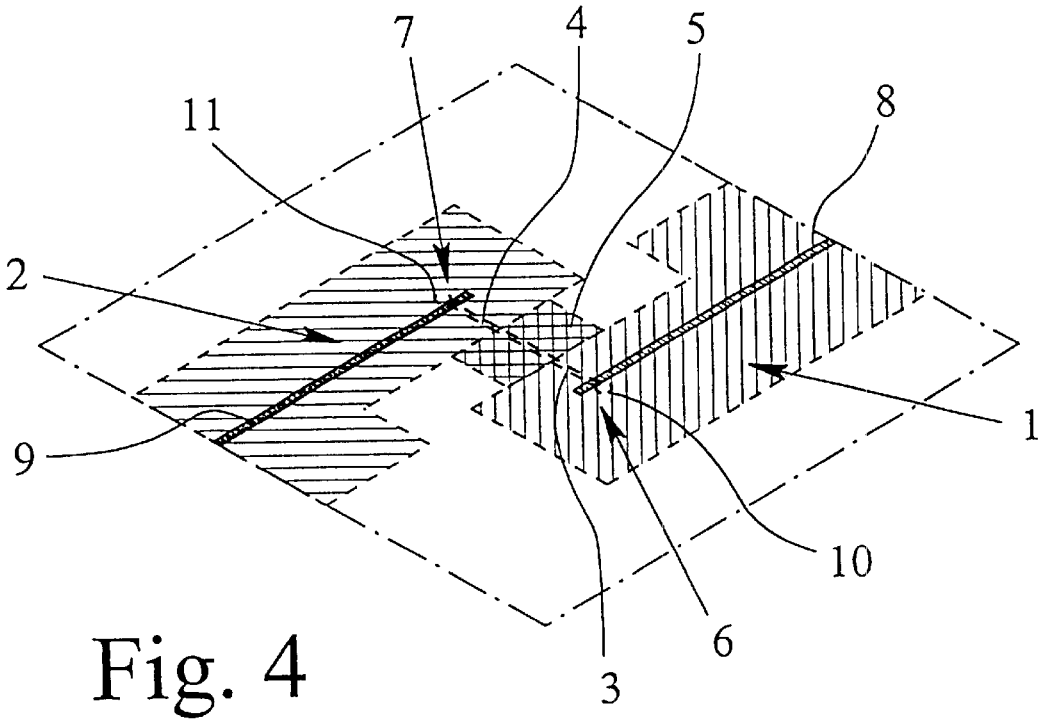

To achieve a simple adaptation of the first line section 1 of the microwave transmission line and the second line second 2 of the microwave transmission line with one coaxial line in each case and with the adaptation preferably carried out via a microstrip line in each case, as can be seen in FIG. 4, a preferred embodiment of the invention provides for a transition 6 from the first slotted line 3 to a first microstrip line 8, on the one hand, and a transition 7 from the second slotted line 4 to a second microstrip line 9, on the other hand. An example of such a transition is illustrated for the first line section 1 of the microwave transmission line in FIG. 2. The transition 6 between the first slotted line 3 and the first microstrip line 8 is formed in that the first slotted line 3 runs perpendicular to the first microstrip line 8, that at its end facing away from the transition to the second slotted line 4 the first slotted line 3 overlaps with an end of the first microstrip line 8, the first microstrip line 8 ends straight shortly after its overlapping with the first slotted line 3, and shortly after its overlapping with the microstrip line 8, the first slotted line 3 ends with a circular recess 10 whose radius corresponds to roughly twice the slot width of the first slotted line 3.

Figure 3:
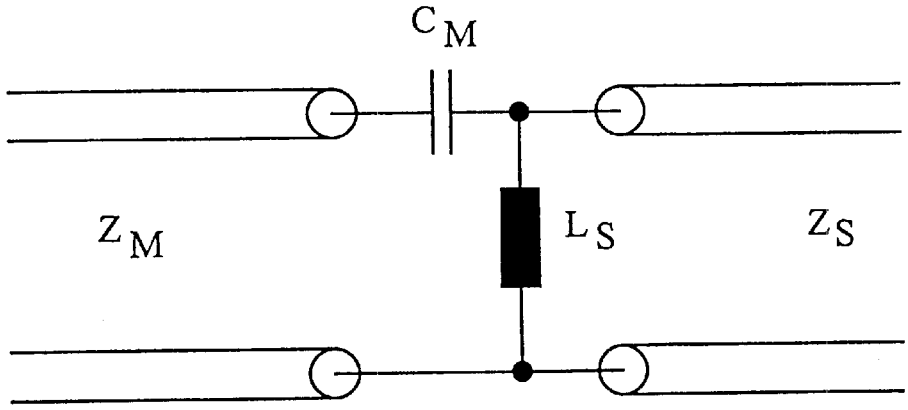

A circuit arrangement corresponding essentially to the equivalent circuit diagram shown in FIG. 3 is obtained by the transition 6 from the first slotted line 3 to the first microstrip line 8. In this connection, the microstrip line coming from the left meets the slotted line continuing to the right. The circular recess whose radius corresponds to roughly twice the slot width of the slotted line in practical reality acts as an inductance, marked $L_S$ in FIG. 4, and the end of the microstrip line can be treated as a capacitor connected in series with the slotted line and whose capacity is marked $C_M$ in the circuit shown in FIG. 4. Furthermore, in FIG. 4 the impedance of the microstrip line is marked $Z_M$ and the impedance of the slotted line is marked $Z_S$.

Figure 5:
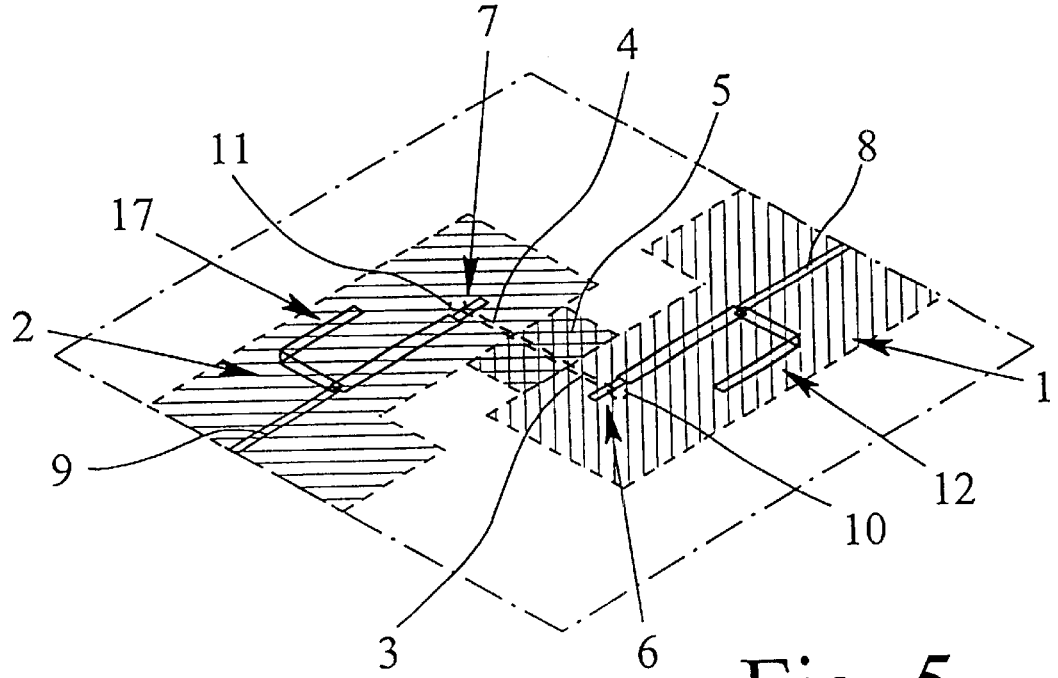

Finally, FIG. 5 shows another preferred embodiment of the potential-free connection that is further improved with respect to the transferred bandwidth of the microwave signal. The arrangement of a series-connected half-wavelength transformer 12, 13. with open end is namely provided for in both line sections 1, 2 in the area of the microstrip line as described, for example, in R. Knöchel "Broadband Flat Coupling Two-Branch and Multibranch Directional Couplers", 1999 IEEE MTT-S International Microwave Symposium, Anaheim, 1999, Pages 1327–1330.

We claim:

1. A potential-free connection of a first line section of a microwave transmission line with a second line section of the microwave transmission line, wherein the first line section of the microwave transmission line has a first slotted line, the second line section of the microwave transmission line has a second slotted line and the first slotted line and the second slotted line are arranged on two opposite sides of a dielectric substrate, at one of its end areas, the first slotted line overlaps the second slotted line at one of the latter's end areas, and the first slotted line and the second slotted line are each widened in the area where they overlap such that the first slotted line and the second slotted line have a strong electromagnetic coupling but have no conductive connection to each other.

2. The potential-free connection according to claim 1, wherein the first slotted line and the second slotted line are straight.

3. The potential-free connection according to claim 2, wherein the first slotted line extends parallel to the second slotted line.

4. The potential-free connection according to claim 3, wherein the first slotted line extends in true alignment with the second slotted line.

5. The potential-free connection according to claim 1, wherein the first slotted line and the second slotted line are each widened beyond the area where they overlap.

6. The potential-free connection according to claim 5, wherein the first slotted line and the second slotted line are each widened over a length of 5.5 mm and overlap over a length of 4 mm.

7. The potential-free,connection according to one of claims 1 through 4, 5 and 6, wherein the dielectric substrate is 0.1 to 0.4 mm thick.

8. The potential-free connection according to one of claims 1 through 4, wherein the dielectric constant of the dielectric substrate is 1.5 to 5.

9. The potential-free connection according to one of claims 1 through 4, wherein the first line section has a first transition from the slotted line to a first microstrip line and/or the second line section has a second transition from the second slotted line to a second microstrip line.

10. The potential-free connection according to claim 9, wherein at the first transition from the first slotted line to the first microstrip line, the first slotted line overlaps the first microstrip line, the first slotted line runs perpendicular to the first microstrip line, the first microstrip line ends straight shortly after its overlapping with the first slotted line, and shortly after its overlapping with the first microstrip line, the first slotted line ends with a circular recess whose radius corresponds to roughly twice the slot width of the first slotted line, and/or at the second transition from the second slotted line to the second microstrip line, the second slotted line overlaps the second microstrip line, the second slotted line runs perpendicular to the second microstrip line, the second microstrip line ends straight shortly after its overlapping with the second slotted line, and shortly after its overlapping with the second microstrip line, the second slotted line ends with a circular recess whose radius corresponds to roughly twice the slot width of the second slotted line.

11. The potential-free connection according to claim 9, wherein the first microwave transmission line and/or the second microwave transmission line each have a transition to a coaxial line.

* * * * *